US011668291B2

(12) United States Patent
Kuo et al.

(10) Patent No.: US 11,668,291 B2
(45) **Date of Patent: *Jun. 6, 2023**

(54) OIL-SCAVENGE PUMP AND METHOD FOR ASSEMBLING THE SAME

(71) Applicant: CHIPMAST AUTOTRONIX CO., LTD., Hshinchu Country (TW)

(72) Inventors: Hung-Ta Kuo, Hshinchu Country (TW); Chi-Ju Lee, Hshinchu Country (TW)

(73) Assignee: CHIPMAST AUTOTRONIX CO., LTD., Hshinchu Country (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/489,442

(22) Filed: Sep. 29, 2021

(65) Prior Publication Data

US 2023/0097493 A1 Mar. 30, 2023

(51) Int. Cl.
*F04B 43/00* (2006.01)
*F04B 43/067* (2006.01)

(52) U.S. Cl.
CPC ..... *F04B 43/0009* (2013.01); *F04B 43/067* (2013.01)

(58) Field of Classification Search
CPC .... F04B 43/0009; F04B 43/067; F04B 39/14; B23P 6/02; B23P 15/00; B23P 15/06; B23P 15/08; F04C 2230/604; F04C 2230/60; F04C 2230/00; B22F 5/02; B23B 2215/247; F16J 9/00
USPC ..... 417/313; 29/888, 888.02, 888.04, 29/888.07, 898.11, 402.02, 524.1, 525, 6, 29/34 B
See application file for complete search history.

(56) References Cited

U.S. PATENT DOCUMENTS 5,232,273 A * 8/1993 Eckstein ..... B60T 8/4068 303/116.4
5,395,219 A * 3/1995 Hosoya ..... F04B 53/1002 417/454
5,567,128 A * 10/1996 Volz ..... B60T 8/4031 417/313
6,000,764 A * 12/1999 Dokas ..... F04B 53/22 137/15.08
6,082,244 A * 7/2000 Siegel ..... B60T 8/4031 417/313

(Continued)

*Primary Examiner* — Kenneth J Hansen
*Assistant Examiner* — Benjamin Doyle
(74) *Attorney, Agent, or Firm* — Chun-Ming Shih; HDLS IPR Services

(57) ABSTRACT

The present disclosure provides an oil scavenge pump, which includes a cap member, a piston member and a resilient member. The cap member and the piston member are connected to each other and with the resilient member therebetween. The cap member includes a cap head, a valve connected to the cap head, a resilient unit disposed between the cap head and the valve, and a first sphere disposed between the resilient unit and the valve. The piston member includes a valve stopper, a main portion, a second sphere, a rod portion, a first-seal ring and a second-seal ring. The main portion has two ends respectively connected to the valve stopper and the rod portion. The second sphere is disposed between the valve stopper and the main portion. The first-seal ring and the second-seal ring respectively surround the main portion and the rod portion.

8 Claims, 5 Drawing Sheets

(56) References Cited

U.S. PATENT DOCUMENTS 6,113,365 A * 9/2000 Siegel ..... B60T 8/4031 417/434
6,126,418 A * 10/2000 Sinnl ..... F04B 53/126 417/470
6,217,300 B1 * 4/2001 Schuller ..... B60T 8/4031 417/454
6,224,352 B1 * 5/2001 Hauser ..... F04B 53/20 417/313
6,283,733 B1 * 9/2001 Merklein ..... F04B 1/0421 92/78
6,302,663 B1 * 10/2001 Schuller ..... F04B 1/0408 417/470
6,334,762 B1 * 1/2002 Hauser ..... F04B 53/168 417/470
6,340,295 B1 * 1/2002 Hauser ..... B60T 8/4031 417/470
6,413,238 B1 * 7/2002 Maget ..... A61M 5/14526 604/67
6,457,956 B1 * 10/2002 Hauser ..... F04B 53/126 417/470
6,520,756 B1 * 2/2003 Alaze ..... B60T 8/4068 417/540
7,237,474 B2 * 7/2007 Schlitzkus ..... F04B 11/0091 92/78
7,390,174 B2 * 6/2008 Dinkel ..... B60T 8/4031 417/570
7,690,899 B2 * 4/2010 Harada ..... F04B 1/0408 417/523
7,704,058 B2 * 4/2010 Harada ..... F04B 53/143 417/549
8,241,020 B2 * 8/2012 Zimmermann ..... F04B 1/0452 417/548
8,353,691 B2 * 1/2013 Sonnenschein ..... F04B 53/126 417/470
8,388,326 B2 * 3/2013 Sumimoto ..... F04B 1/0408 417/470
8,523,541 B2 * 9/2013 Hermann ..... B60T 8/4031 137/15.19
8,845,038 B2 * 9/2014 Hipp ..... F04B 53/10 92/255
9,174,620 B2 * 11/2015 Starr ..... B60T 17/02
9,759,204 B2 * 9/2017 Braun ..... F04B 1/0439
10,730,496 B2 * 8/2020 Schumann ..... F04B 53/001
11,111,914 B2 * 9/2021 Choi ..... B60T 17/02
2001/0016171 A1 * 8/2001 Schuller ..... F04B 53/168 417/545
2001/0048884 A1 * 12/2001 Siegel ..... F04B 53/126 417/470
2002/0155008 A1 * 10/2002 Hauser ..... F04B 53/20 417/313
2005/0063846 A1 * 3/2005 Maeda ..... B60T 8/4031 417/471
2005/0074348 A1 * 4/2005 Maeda ..... B60T 8/4031 417/470
2006/0013702 A1 * 1/2006 Dinkel ..... F04B 1/0408 417/559
2006/0177326 A1 * 8/2006 Harada ..... F04B 1/0452 417/470
2007/0092389 A1 * 4/2007 Dinkel ..... F04B 53/168 417/554
2007/0114837 A1 * 5/2007 Kusano ..... B60T 7/042 417/259
2008/0226479 A1 * 9/2008 Schuller ..... F04B 53/14 417/545
2009/0045380 A1 * 2/2009 Aiken ..... B66F 3/247 254/131
2014/0023544 A1 * 1/2014 Lucas ..... F04C 14/06 418/69
2017/0291586 A1 * 10/2017 Norberg ..... F04B 11/00

* cited by examiner

OIL-SCAVENGE PUMP AND METHOD FOR ASSEMBLING THE SAME

TECHNICAL FIELD

The present disclosure relates to an oil scavenge pump, a hydraulic device having the same and a method for assembling the same, which can be assembled in a hierarchical, step-by-step manner.

BACKGROUND

For safe driving, many modern vehicles are disposed with anti-lock braking systems (ABS), which are adapted to adjust braking function of wheels, such that to adjust traction force and prevent the wheels from locking up then slipping out of control, during emergency braking or driving on a road with inappropriate condition.

Common ABS systems can adjust the traction force by utilizing combination of software (programming), hardware (controller) and transmission mechanisms, such that to help gaining controllability of the vehicle against any accident. The modern ABS systems mainly employ hydraulic equipment as the transmission mechanism, which is assembled from multiple components connected to each other by welding, such that to achieve high fluid tightness.

The welding process can easily bind, connect surfaces in different or complicated shapes together, however the connection by welding is vulnerable to vibration and high temperature. A hydraulic equipment with motors and pumps that generates vibrations and heat, which may lose its fluid-tight condition after some usage, especially when the emergency brake is applied, the hydraulic equipment works at an instantly fast rate, which also generates enormous vibrations and heat in short burst and may destruct and break up the connection between welded components, and thereby to cause failure of the ABS system.

Oil scavenge pump is an oil-flow-control unit within a hydraulic device, which is required to work and stop in an instant, intermittent manner, thus a large amount of machine stress and vibration can occur in a short burst, and therefore which is also required to be secured, tightly fastened within the hydraulic device. A conventional oil scavenge pump has a complicated structure, which may hence cause a difficulty of assembling, and moreover, by an improper, inaccurate assembling process, it can be also difficult to mount and secure the oil scavenge pump within the hydraulic device well. In addition, a welding process may be applied to help fastening the oil scavenge pump within the hydraulic device, however, a quality of the welding may also be difficult to control, and therefore to cause an unstable quality of product.

SUMMARY

Therefore, to overcome the abovementioned drawbacks of the conventional technology, the present disclosure provides an oil scavenge pump, which includes three pre-assembled components as a cap member, a piston member and a resilient member. With such improved structure and configuration, an assembling of the oil scavenge pump can be simplified, also the oil scavenge pump can be fastened and sealed within the hydraulic device by riveting. Thereby, there is no need of the welding process with unstable quality for mounting the oil scavenge pump into the hydraulic device, a safety system of vehicle can be improved.

According to at least one of the abovementioned object, the present disclosure provides a method for assembling the oil scavenge pump, which includes: a step of hierarchically pre-assembling three components, as a cap member, a piston member and a resilient member; a next step of sequentially mounting the piston member, the resilient member and the cap member into a mounting slot of the hydraulic device; then a final step of fastening the oil scavenge pump on a main body of the hydraulic device by riveting. Such hierarchical method for assembling the oil scavenge pump can have all components sequentially, properly assembled into the mounting slot in accordance with their functions, this does not only simplify the assembling process of the oil scavenge pump into the hydraulic device, but also enhance a structural strength and connection between the oil scavenge pump and the hydraulic device.

According to at least one of the abovementioned object, the present disclosure provides a hydraulic device, which includes a main body, an oil scavenge pump, and a hydraulic component (e.g. motor, pressure-increasing valve, pressure-decreasing valve or electronic control unit, etc.) mounted on the main body. The main body has a mounting slot for containing the oil scavenge pump therein, and wherein the mounting slot is formed correspondingly to exteriors of those pre-assembled components of the oil scavenge pump, such that the oil scavenge pump can tightly contact and fit an inner wall of the mounting slot, therefore to enhance a structural strength and connection between the oil scavenge pump and the hydraulic device.

According to at least one of the abovementioned object, the present disclosure provides an oil scavenge pump, which includes a cap member, a piston member and a resilient member. The cap member and the piston member are connected to each other, with the resilient member therebetween. The cap member includes a cap head, a valve, a resilient unit and a first sphere. The valve is connected to the cap head, with the resilient unit disposed between the valve and the cap head, and the first sphere is disposed between the resilient unit and the valve. The piston member includes a valve stopper, a main portion, a second sphere, a rod portion, a first-seal ring and a second-seal ring. The main portion interconnects the valve stopper and the rod portion, the second sphere is disposed between the valve stopper and the main portion, the first-seal ring and the second-seal ring are mounted to surround an outer surface of the main portion and an outer surface of the rod portion.

Optionally, a first-connecting end and a second-connecting end of the main portion are respectively connected to the valve and the rod portion. The first-connecting end has an outer diameter larger than that of the second-connecting end, the valve has an inner diameter substantially equal to the first-connecting end of the main portion, the rod portion has an outer diameter less than that of the second-connecting end of the main body.

Optionally, the main portion is a rod formed with two through holes, wherein both of the two through holes have diameters different from each other.

Optionally, the oil scavenge pump further includes two pads respectively disposed on two sides of the first-seal ring.

Optionally, the oil scavenge pump further includes an oil inlet disposed on the main portion, and an oil outlet disposed on the valve.

Optionally, the first-seal ring is an X-ring, the second-seal ring is an O-ring, the resilient member and the resilient unit are springs, the first sphere and the second sphere are steel balls.

According to at least one of the abovementioned object, the present disclosure provides a method for assembling the oil scavenge pump, which is adapted to a hydraulic device with an oil entrance, an oil exit and a mounting slot, and which includes: a step of pre-assembling the piston member; a step of pressing the pre-assembled piston member into an end adjacent to the oil outlet within the mounting slot of the hydraulic device, in a manner of an interference fit; a step of placing the resilient member into the mounting slot and contacting the inner wall of the mounting slot by the valve stopper of the resilient member; a step of pre-assembling the cap member; a step of pressing the pre-assembled cap member into the mounting slot of the hydraulic device, in a manner of an interference fit, wherein the piston member, the resilient member and the cap member are assembled into the oil scavenge pump; and a step of fastening the oil scavenge pump within the mounting slot by riveting.

Optionally, the step of pressing the cap member into the mounting slot, which further includes a process of connecting the valve of the cap member and the main portion of the piston member, such that to position the resilient member between the cap member and the piston member.

According to at least one of the abovementioned object, the present disclosure provides a hydraulic device, which includes a main body having a mounting slot, an oil scavenge pump mounted into the mounting slot, and a hydraulic component disposed within the main body. The first-seal ring and the second-seal ring of the oil scavenge pump, both have outer surfaces that fits the inner wall of the mounting slot.

Optionally, the main portion of the oil scavenge pump is a cylinder rod, which has a radial-outmost surface fitting the inner wall of the mounting slot.

To be brief, the present disclosure provides an oil scavenge pump, a hydraulic device using the same and a method for assembling the same, wherein the oil scavenge pump can have pre-assembled three components (the cap member, the piston member and the resilient member) for example, such that to simplify, facilitate the assembling process and also to omit welding process. Moreover, a riveting process to fasten the oil scavenge pump, which can improve a fluid tightness and durability of the hydraulic device, and further ensure the driving safety, therefore the hydraulic device has advantages for different needs in market (e.g. car makers, motorcycle makers, ABS makers, etc.).

BRIEF DESCRIPTION OF THE DRAWINGS

The structure as well as preferred modes of use, further objects, and advantages of this present disclosure will be best understood by referring to the following detailed description of some illustrative embodiment(s) in conjunction with the accompanying drawings, in which.

DETAILED DESCRIPTION OF THE PREFERRED EMBODIMENTS

To fully understand the objects, features and functions of the present disclosure, herein to explain details thereof by the following embodiment(s), with the attached drawings.

The present disclosure provides an oil scavenge pump, which includes three pre-assembled components, as a cap member, a piston member and a resilient member. The hydraulic device has a main body, which is formed with a plurality of mounting slots spatially connected to each other for mounting the oil scavenge pump and other components (e.g. motor, pressure-increasing valve, pressure-reducing valve, etc.). The cap member, the piston member and the resilient member of the oil scavenge pump can be hierarchically assembled into one of the mounting slots. each of the components of the oil scavenge pump is formed with a structure corresponding to the mounting slot of the main body, such that the fully assembled oil scavenge pump can have those components thereof connected in a more stable manner, and therefore the assembling process thereof can also be simplified. According to the description above, the present disclosure also provides a method for assembling the oil scavenge pump, and a hydraulic device having the oil scavenge pump.

Figure 1:
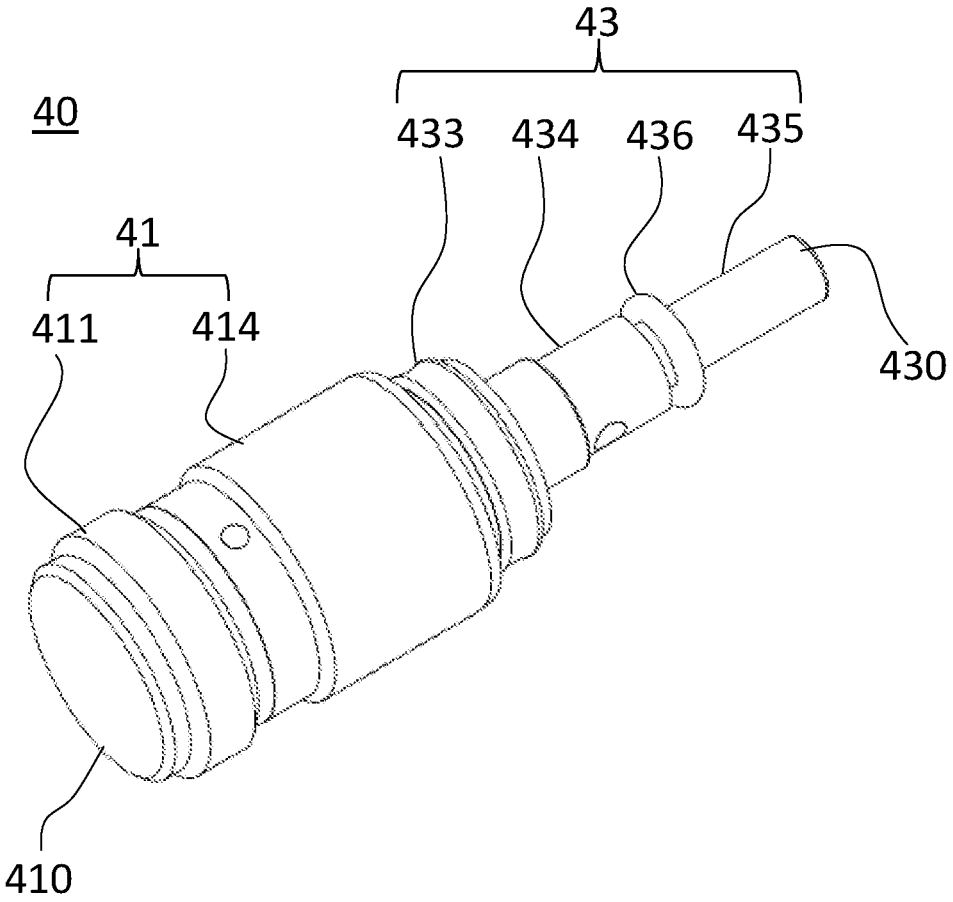
FIG. 1 is a perspective view of an oil scavenge pump according to one embodiment of the present disclosure.
Figure 2:
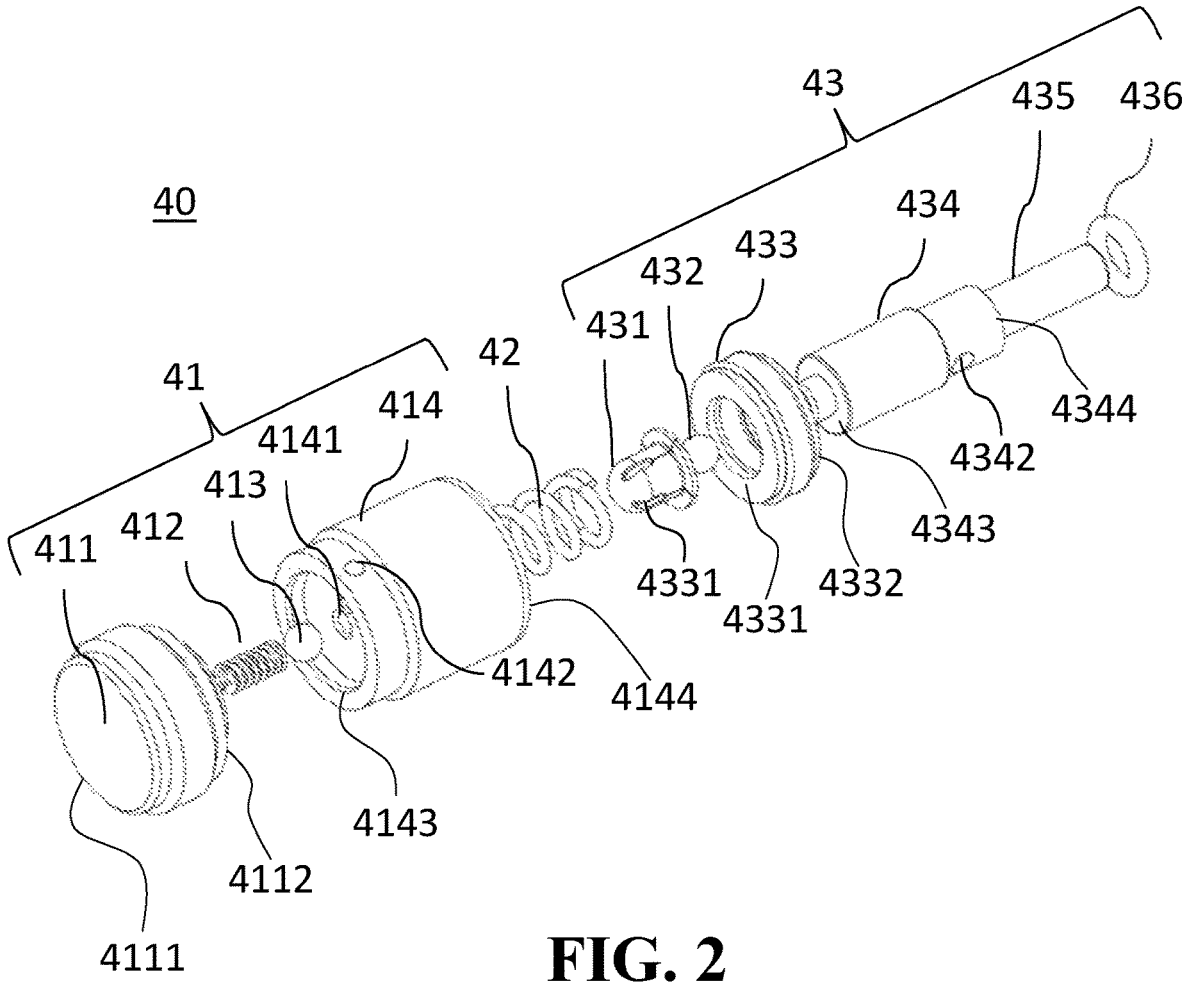
FIG. 2 is a perspective exploded view of the oil scavenge pump according to one embodiment of the present disclosure.
Figure 3:
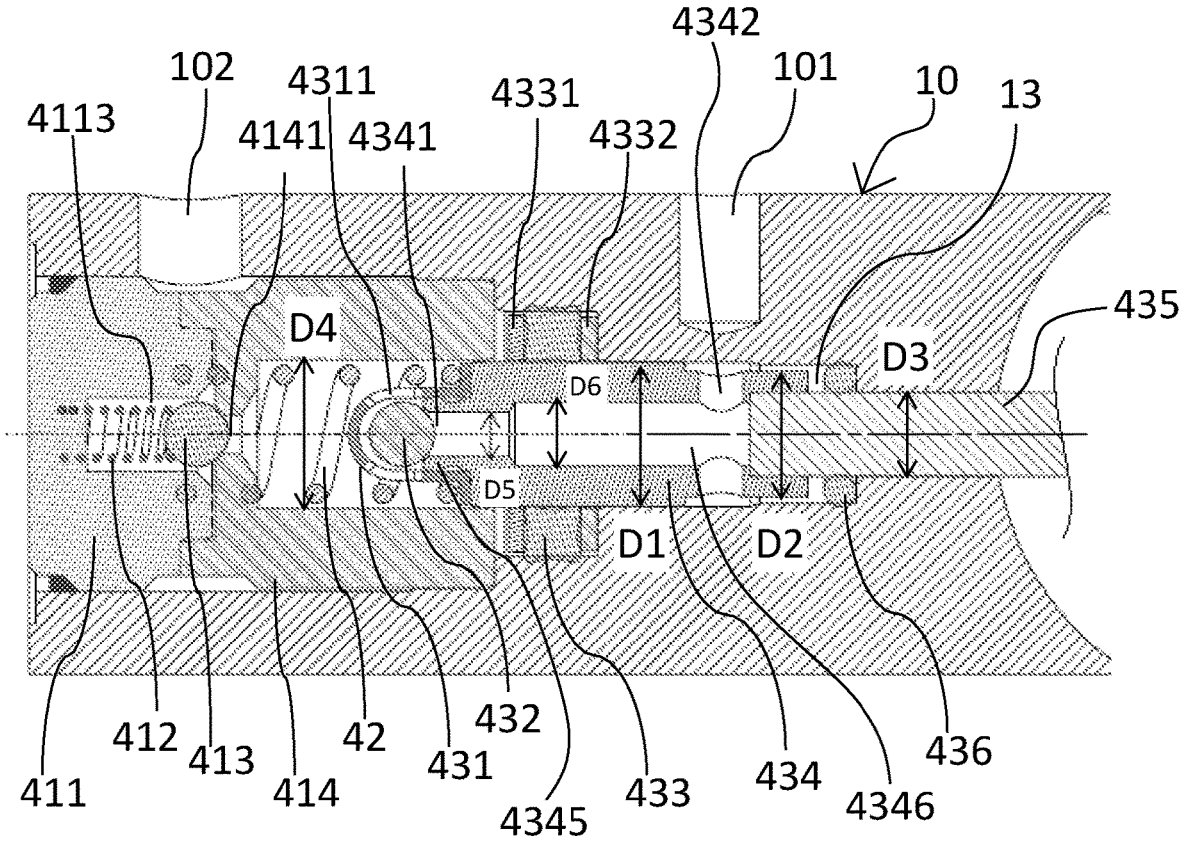
FIG. 3 is a fragmentary sectional view illustrating the oil scavenge pump mounted into a main body of a hydraulic device, according to one embodiment of the present disclosure.

First referring to FIG. 1-FIG. 3, which are respectively a perspective and an exploded view of an oil scavenge pump 40, and a fragmentary sectional view of the oil scavenge pump 40 mounted into a main body 10 of a hydraulic device. As shown in FIG. 1, the oil scavenge pump 40 has a proximately cylindrical appearance, and has a head end 410 and a rod end 430 opposite to each other.

Specifically, the oil scavenge pump 40 includes three components, as a cap member 41, a resilient member 42 and a piston member 43. The cap member 41 is positioned at the head end 410, the piston member 43 is positioned at the rod end 430, and the resilient member 42 is positioned between the cap member 41 and the piston member 43.

In more detail, as shown in FIG. 2, the cap member 41 includes a cap head 411, a resilient unit 412, a first sphere 413 and a valve 414. The cap head 411 is positioned at the head end 410, the resilient unit 412 and the first sphere 413 are positioned within the cap head 411. The valve 414 and the cap head 411 are connected to each other, such that to position and retain the resilient unit 412 and the first sphere 413 therebetween. The resilient unit 412 has an end contacting and abutting the cap head 411, and another end contacting and abutting the first sphere 413. When the first sphere 413 is in a normal state (such as shut-off or inactive but not limited thereto), the first sphere 413 is pushed by the resilient unit 412 to plug and block a valve-through hole 4141 (in detail later) of the valve 414. Moreover, the valve 414 has an inner space for containing the resilient member 42 therein.

To be specific, the cap head 411 has a proximately cylindrical appearance, which has a first-cap end 4111 sealed off and a second-cap end 4112 formed with a cap opening 4113 (FIG. 3). The resilient unit 412 and the first sphere 413 are disposed into the cap opening 4113 of the cap head 411. The valve 414 also has a proximately cylindrical appearance, and has a first-valve end 4143 and a second-valve end 4144, as shown in FIG. 2. Furthermore, the valve 414 also formed with the valve-through hole 4141 extending from the first-valve end 4143 to the second-valve end 4144, wherein the valve-through hole 4141 is formed narrower at the first-valve end 4143 and wider at the second-valve end 4144, as shown in FIG. 3. The valve 414 is engaged with the cap opening 4113 of the cap head 411, such that to position and retain the resilient unit 412 and the first sphere 413 therebetween, and to assemble into the cap member 41, wherein the valve-through hole 4141 is spatially connected to the cap opening 4113.

As shown in FIG. 2 and FIG. 3, the piston member 43 includes a valve stopper 431, a second sphere 432, a first-seal ring 433, a main portion 434, a rod portion 435 and a second-seal ring 436. The first-seal ring 433 is mounted to surround an outer surface of the main portion 434, the second sphere 432 is disposed between and contained by both of the valve stopper 431 and the main portion 434. In the other hand, the rod portion 435 is disposed at the rod end 430 of the oil scavenge pump 40, the second-seal ring 436 is mounted to surround an outer surface of the rod portion 435.

The main portion 434 has a proximately tubular appearance, and has two opposite ends as first-connecting end 4343 and second-connecting end 4344. The first-connecting end 4343 and a second-connecting end 4344 are respectively connected to the valve stopper 431 and the rod portion 435.

Specifically, the first-connecting end 4343 of the main portion 434 has an outer diameter D1 larger than an outer diameter D2 of the second-connecting end. As shown in FIG. 3, the main portion 434 is formed hollow within, wherein the first-connecting end 4343 is formed with a first-through hole 4341, the second-connecting end 4344 is also formed with a second-through hole 4346 spatially connected to the first-through hole 4341. Moreover, the first-through hole 4341 has a diameter D5 smaller than a diameter D6 of the second-through hole 4346. In this embodiment, a length of the first-through hole 4341 is not equal to that of the first-connecting end 4343, and a length of the second-through hole 4346 is also not equal to that of the second-connecting end 4344, however claim scope of the present disclosure is not limited to such configuration. Also to mention that, the first-connecting end 4343 of the main portion 434 includes an anchor structure 4345 for engaging with the valve stopper 431.

As shown in FIG. 3, in a normal state, the second sphere 432 plugs and blocks the first-through hole 4341 of the main portion 434. The main portion 434 is connected to an end of the valve stopper 431, and further enters the valve-through hole 4141 to engage with the valve 414. Such that, the valve stopper 431 and the resilient member 42 are positioned and retained between the valve 414 and the main portion 434, and contained within the valve-through hole 4141.

As shown in FIG. 2 and FIG. 3, the valve stopper 431 has a dome-like appearance, however is not limited thereto. Furthermore, the valve stopper 431 includes an exterior formed with plurality of openings 4311 thereon, and an interior formed with a cavity for containing the second sphere 432. Moreover, the interior of the valve stopper 431 tightly contacts and engage with the anchor structure 4345 of the main portion 434, however the claim scope of the present disclosure is not limited to such manner of engagement therebetween. Thereby, the valve stopper 431 is fastened on the first-connecting end 4343 of the main portion 434, also to retain the second sphere 432 between the valve stopper 431 and the main portion 434.

The rod portion 435 is connected to the second-connecting end 4344 of the main portion 434. The rod portion 435 also has a proximately cylindrical appearance, and has an outer diameter D3 smaller than the outer diameter D2 of the second-connecting end 4344 of the main portion 434 but larger than the diameter D6 of the second-through hole 4346. The first-seal ring 433 and the second-seal ring 436 are respectively mounted to surround the outer surface of the first-connecting end 4343 of the main portion 434 and the outer surface of the rod portion 435, such that to assemble into the piston member 43.

In one embodiment, the piston member 43 further includes two annular pads 4331, 4332 respectively disposed on two opposite sides of the first-seal ring 433, such that, the pads 4331, 4332 also surround the outer surface of the first-connecting end 4343 of the main portion 434. In addition, the oil scavenge pump 40 further includes an oil inlet 4342 disposed on the second-connecting end 4344 of the main portion 434, and an oil outlet 4142 disposed on a lateral side of the first-valve end 4143 and spatially connected to the cap opening 4113 of the cap member 41, thereby to allow a hydraulic fluid (e.g. oil or other liquid fluids) flowing in and out of the oil scavenge pump 40.

As shown in FIG. 3, the resilient member 42 is positioned within the valve-through hole 4141 of the valve 414. The resilient member 42 has an end abutting an inner wall of the valve 414, and another end abutting the valve stopper 431. The first-connecting end 4343 of the main portion 434 of the piston member 43 is connected to the first-valve end 4143 of the valve 414 of the cap member 41, wherein the outer diameter D1 of the first-connecting end 4343 of the main portion 434 is equal to an inner diameter D4 of the containing space of the valve 414. Such that, when the piston member 43 and the cap member 41 are connected, the resilient member 42 is positioned between the piston member 43 and the cap member 41, to assemble into the oil scavenge pump 40.

In one embodiment, the resilient unit 412 and the resilient member 42 are restoring springs, the first sphere 413 and the second sphere 432 are steel balls with same sizes, the first-seal ring 433 is an X-ring, the second-seal ring 436 is an O-ring. However, the claim scope of the present disclosure is not limit thereto.

Figure 5:
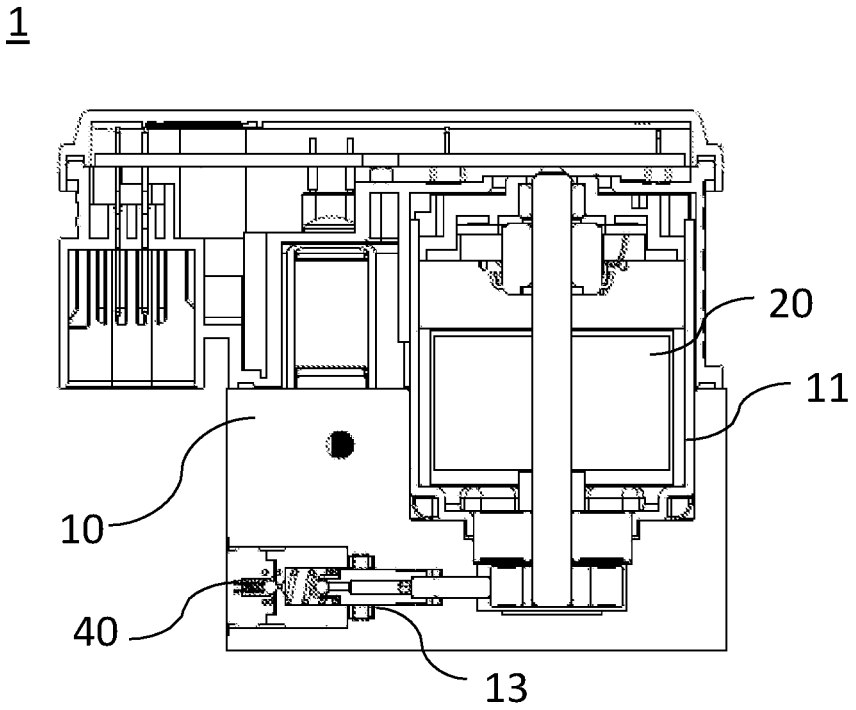
FIG. 5 is a sectional view of a hydraulic device, according to one embodiment of the present disclosure.

Also referring to FIG. 5, which is a sectional view of the hydraulic device 1, according to one embodiment of the present disclosure. The hydraulic device 1 includes a main body 10 formed with a plurality of mounting slots 11, 13 spatially connected to each other, an oil entrance 101 and an oil exit 102 adjacent to the mounting slots 13, wherein the mounting slot 13 is for mounting the oil scavenge pump 40 therein. Specifically, the mounting slot 13 may include multiple space areas formed with different diameters, wherein the diameters of the space areas are configured wider on an external side of the main body 10 and narrower in an internal side of the main body 10, and the diameters of the space areas is formed narrower and narrower from the external side to the internal side sequentially, and thereby an inner wall of the mounting slot 13 is formed with multiple round steps. Before the oil scavenge pump 40 is assembled into the mounting slot 13 on the main body 10 of the hydraulic device 1, since the cap member 41, the resilient member 42 and the piston member 43 of the oil scavenge pump 40 are individually pre-assembled in advance, the three components 41, 42, 43 can be mounted into the mounting slot 13 sequentially then be fastened and sealed off, such that oil scavenge pump 40 is properly mounted into the mounting slot 13.

Specifically, the assembling process is first to mounting the pre-assembled piston member 43 into the mounting slot 13, with the rod portion 435 entering the mounting slot 13, wherein a radial-outmost surface (with the largest diameter D1) of the main portion 434 of the piston member 43 contacts and fits the inner wall of the mounting slot 13. Also, the first-seal ring 433 and the second-seal ring 436 are mounted into the mounting slot 13 in a manner of interference fit, such that an outer surface of the first-seal ring 433 and an outer surface of the second-seal ring 436 tightly contact and fit the inner wall of the mounting slot 13, for fastening and sealing the piston member 43. Furthermore, when the piston member 43 is mounted in, an end of the rod portion 435 enters the mounting slot 11 from the mounting slot 13 to power-transmittably connected to a drive unit 20. Thereafter, the resilient member 42 is mounted into the mounting slot 13, adjacent to the piston member 43. On next, the pre-assembled cap member 41 is mounted into the mounting slot 13 in a manner of interference fit, wherein the resilient member 42 is contained within the valve-through hole 4141 of the valve 414 of the cap member 414. At last, the three components 41, 42, 43 are pressed into the mounting slot 13 of the main body 10 and assembled as the oil scavenge pump 40, and be fastened on the main body 10 by a riveting process.

By virtue of such structure and configuration of the oil scavenge pump 40, which does not only reduce number of component for the oil scavenge pump 40, but also simplify the process of assembling the oil scavenge pump 40 into the main body 10 of the hydraulic device 1, by virtue of the three pre-assembled components 41, 42, 43.

Figure 4:
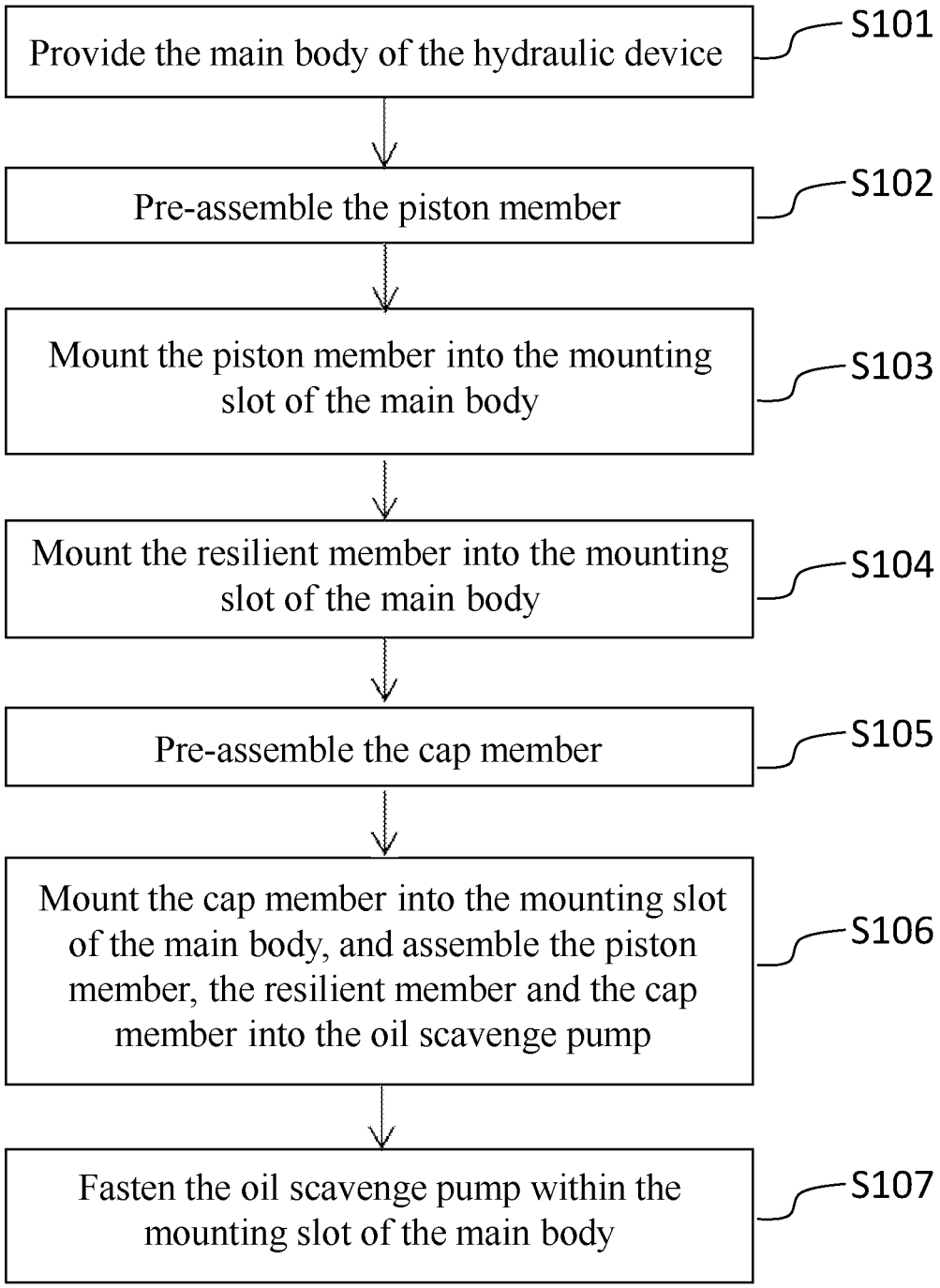
FIG. 4 is a flowchart of a method for assembling the oil scavenge pump, according to one embodiment of the present disclosure.

On next, referring to FIG. 4, which is a flowchart of a method for assembling the oil scavenge pump 40, according to one embodiment of the present disclosure. The method for assembling the oil scavenge pump 40 adapted to the main body 10 of the hydraulic device 1, which includes several steps S101-S107. The step S101 is to provide the main body 10 of the hydraulic device 1, wherein the main body 10 is disposed with the mounting slot 13, the oil entrance 101 and the oil exit 102.

The step S102 is to pre-assemble the piston member 43, which includes a process of mounting the second sphere 432 into the valve stopper 431 and engage the first-connecting end 4343 of the main portion 434 with the valve stopper 431, such that to retain the second sphere 432 between the valve stopper 431 and the main portion 434. Also, the step S102 includes a process of engaging the rod portion 435 with second-connecting end 4344 of the main portion 431 in a manner of interference fit, furthermore to mount the first-seal ring 433 and the second-seal ring 436 to respectively surround the outer surface of the main portion 434 and the outer surface of the rod portion 435.

The step S103 is to press the pre-assembled piston member 43 straight into the mounting slot 13 with the rod portion 435 entering first, in a manner of interference fit and having the main portion 434 adjacent to, meanwhile to respectively mount the first-seal ring 433 and the second-seal ring 436 on the round steps within the mounting slot 13. Such that, the outer surfaces of the first-connecting end 4343 on the main portion 434, the first-seal ring 433 and the second-seal ring 436 tightly contact, fit the inner wall of the mounting slot 13, thereby the piston member 43 is secured, positioned within the mounting slot 13.

The step S104 is to mount the resilient member 42 straightly into the mounting slot 13 of the main body 10, and have the resilient member 42 contacting the valve stopper 431 of the piston member 43.

The step S105 is to pre-assemble the cap member 41, which includes a process of mounting the resilient unit 412 and the first sphere 413 into the first-containing space of the cap head 411, and engage the first-connecting end 4143 of the valve 414 with the first-cap end 4111 of the cap head 411 in a manner of interference fit, such that to complete the assembling of the cap member 41.

The step S106 is to press the pre-assembled cap member 41 straight into the mounting slot 13 of the main body 10 with the valve 414 entering first and adjacent to the oil exit 102 of the main body 10, in a manner of interference fit. Also in step S106 to engage the valve-through hole 4141 of the valve 414 with the first-connecting end 4343 of the main portion 434, in a manner of interference fit and having the resilient member 42, the valve stopper 431 and the second sphere 432 contained between the valve 414 and the main portion 434, such that to assemble into the oil scavenge pump 40. Moreover, during the process of pressing the pre-assembled cap member 41, which also includes a process of having the valve 414 to contact and be held by one of the round steps within the mounting slot 13, thereby to position and secure the cap member 41 therein.

The step S107 is to apply a riveting process to the head end 410 (i.e. the cap head 411 of the cap member 41) of the oil scavenge pump 40, thereby to further fasten the oil scavenge pump 40 on the main body 10 and within the mounting slot 13.

As described above, the oil scavenge pump 40 is separate into three components 41, 42, 43, wherein those components 41, 42, 43 can be pre-assembled sequentially, such as to pre-assemble the cap member 41 and the piston member 43 at first, wherein the resilient member 42 is a single component formed in one piece hence no need of pre-assembling. However, the present disclosure is not limited thereto, in other embodiments, the resilient member may be configured to have multiple parts and hence required to pre-assemble.

Although, in this embodiment, the method is first to pre-assemble the piston member 43 (step S102), then to pre-assemble the cap member 41 (and step S105), before assembling those components 41, 42, 43 into the main body 10 of the hydraulic device 1, however the present disclosure is not limited thereto, a sequence of pre-assembling the cap member 41 and the piston member 43 is configurable and alterable, it is only sufficient to complete the pre-assembling process thereof before mounting into the main body 10 of the hydraulic device 1.

Also, in one embodiment, it can be optional to individually pre-assemble all of the cap member 41, the resilient member 42 and the piston member 43, before mounting into the main body 10. As such, the process starts with mounting, inserting the piston member 43 into the mounting slot 13 with the rod portion 435 thereof entering first, and to have the outer surface of the piston member 43 tightly contacting and fitting the inner wall of the mounting slot 13. The next is to place the resilient member 41 into the mounting slot 43, and have the resilient member 41 contacting the valve stopper 431 of the piston member 43. Thereafter to mount, insert the cap member 41 into the mounting slot 13 with the valve 414 entering first, and have the outer surface of the cap member 41 tightly contacting and fitting the inner wall of the mounting slot 13.

The three components 41, 42, 43 can be connected to each other in manner of interference fit or press fit, to assemble into the oil scavenge pump 40. The three components 41, 42, 43 may be first placed into the mounting slot 13 then be assembled together by single press-fit process at once, or else to be placed into the mounting slot 13 one-by-one and be assembled step-by-step with multiple press-fit processes, the present disclosure is not limited to only one assembling manner.

Furthermore, after the oil scavenge pump 40 is mounted into the mounting slot 13 of the main body 10, the oil entrance 101 adjacent to the mounting slot 13 is fluidly connected to the oil inlet 4342 of the piston member 43, also, the oil exit 102 adjacent to the mounting slot 13 is fluidly connected to the oil outlet 4142 of the cap member 41. Such that, the hydraulic device 1 can apply a hydraulic fluid (e.g. oil but not limited thereto) and allow the hydraulic fluid to flow into the oil inlet 4342 and the second-through hole 4346 of the piston member 43 and enter the oil scavenge pump 40. As shown in FIG. 3, when the rod portion 435 of the piston member 43 is driven by the drive unit 20 to move toward the cap member 41 and create a pressure, the hydraulic fluid is forced to push the second sphere 432 out of the first-through hole 4341, and thus the hydraulic fluid flows out of the openings 4311 of the valve stopper 431. The hydraulic fluid flows out of the valve stopper 431 then push the first sphere 41 out of the valve-through hole 4141 on the valve 414, such that the hydraulic fluid flows out of the oil outlet 4142 on the cap member 41 and enters the oil exit 102 of the main body 10.

In one embodiment, the hydraulic device 1 is an anti-lock brake system (ABS) device, the main body 10 is a bottom seat, and the drive unit 20 is a motor, in the other hand, the oil scavenge pump 40 mounted into the main body 10 is power-transmittably connected to the motor 20 and driven by the motor 20, via the mounting slots 11, 13. However, the present disclosure is not limited to such structure, the oil scavenge pump 40 may be indirectly but yet power-transmittably connected to the drive unit 20.

In summary of the abovementioned embodiments, in contrary to the conventional technology, the oil scavenge pump 40, the hydraulic device 1, and the method for assembling the oil scavenge pump 40 according to the present disclosure, which have the following technical advantages.

For the conventional technology, the components of the hydraulic device are fastened and sealed off by welding, however the quality of welding is unstable and hence to also cause unstable fluid tightness of the hydraulic device, moreover, the connection by welding is vulnerable to high temperature and vibration, which can cause safety problems in an operation of the hydraulic device.

In the other hand, the hydraulic device according to the present disclosure, which has a relatively simplified structure and assembling manner, thus a riveting process is applicable to achieve a fine quality of fluid tightness, and therefore no need of welding, which also can secure the components from damage or even breaking apart by rapid vibration or high temperature generated during the operation of the hydraulic device. Furthermore, the oil scavenge pump according to the present disclosure tightly contacts and fits the inner wall of the hydraulic device, which does not only enhance the fluid tightness but also the connection between components, and hence to secure and stabilize the oil scavenge pump. Also, the method according to the present disclosure, which separates the oil scavenge pump into three components, such that to reduce the processes for mounting the oil scavenge pump into the main body, and thereby to facilitate an efficiency of the assembling process.

The above disclosure is only the preferred embodiment of the present disclosure, and not used for limiting the scope of the present disclosure. All equivalent variations and modifications on the basis of shapes, structures, features and spirits described in claims of the present disclosure should be included in the claims of the present disclosure.

We claim:

1. An oil scavenge pump, comprising:

a main body, having a mounting slot, an oil entrance and an oil exit;

a cap member comprising a cap head, a valve connected to the cap head, a resilient unit disposed between the cap head and the valve, and a first sphere disposed between the resilient unit and the valve;

a piston member comprising a valve stopper, a main portion connected to the valve stopper, a second sphere disposed between the valve stopper and the main portion, a rod portion connected to the main portion, a first-seal ring mounted to surround an outer surface of the main portion, and a second-seal ring mounted to surround an outer surface of the rod portion; and a resilient member disposed between the cap member and the piston member;

wherein the oil scavenge pump is characterized in that the piston member is pressed and mounted into the mounting slot in a manner of interference fit and having the piston member adjacent to the oil entrance; the resilient member is mounted into the mounting slot and having the resilient member in contact with the valve stopper of the piston member; and the cap member pressed and mounted into the mounting slot in a manner of interference fit and having the cap member, the resilient member, and the piston member assembled into the mounting slot.

2. The oil scavenge pump according to claim 1, wherein:

the main portion has a first-connecting end connected to the valve stopper, and a second-connecting end connected to the rod portion;

the first-connecting end has an outer diameter larger than an outer diameter of the second-connecting end;

the valve has an inner diameter substantially equal to the outer diameter of the first-connecting end; and the rod portion has an outer diameter smaller than the outer diameter of the second-connecting end.

3. The oil scavenge pump according to claim 1, wherein the main portion has a tubular appearance and has two opposite ends respectively formed with a first-through hole and a second-through hole, and wherein the first-through hole has a diameter different from that of the second-through hole.

4. The oil scavenge pump according to claim 1, further comprising two pads respectively disposed on two sides of the first-seal ring.

5. The oil scavenge pump according to claim 1, wherein the main portion of the piston member has an oil inlet, the valve of the cap member has an oil outlet.

6. The oil scavenge pump according to claim 1, wherein the first-seal ring is an X-ring, the second-seal ring is an O-ring, the resilient member and the resilient unit are springs, the first sphere and the second sphere are steel balls.

7. A method for assembling an oil scavenge pump comprising:

a step of pre-assembling a piston member by assembling a valve stopper, a main portion, a second sphere, a rod portion, a first-seal ring and a second-seal ring together to form the piston member; wherein the main portion is connected to the valve stopper, the second sphere is disposed between the valve stopper and the main portion, the rod portion is connected to the main portion, the first-seal ring is mounted to surround an outer surface of the main portion, and the second-seal ring is mounted to surround an outer surface of the rod portion;

a step of pressing and mounting the piston member into a mounting slot of a main body in a manner of interference fit and having the piston member adjacent to the oil entrance;

a step of mounting the resilient member into the mounting slot and having the resilient member in contact with the valve stopper of the piston member;

a step of pre-assembling a cap member by assembling a cap head, a valve, a resilient unit and a first sphere together to form the cap member; wherein the valve is connected to the cap head, the resilient unit is disposed between the cap head and the valve, and the first sphere is disposed between the resilient unit and the valve;

a step of pressing and mounting the cap member into the mounting slot in a manner of interference fit and having the cap member, the resilient member and the piston member assembled into the oil scavenge pump; and a step of fastening the cap member, the resilient member, and the piston member within the mounting slot.

8. A method according to claim 7, wherein the step of pressing and mounting the cap member into the mounting slot, which further comprises a process of connecting the valve of the cap member to the main portion of the piston member, and positioning and retaining the resilient member between the cap member and the piston member.

* * * * *